United States Patent [19]

Schmitz

[11] Patent Number: 4,975,128

[45] Date of Patent: Dec. 4, 1990

[54] METHOD FOR HEAT-TREATING STRAIGHT BEAD WELDED PIPES

[75] Inventor: Friedhelm Schmitz, Dinslaken, Fed. Rep. of Germany

[73] Assignee: Siemens Aktiengesellschaft, Munich, Fed. Rep. of Germany

[21] Appl. No.: 223,683

[22] Filed: Jul. 25, 1988

Related U.S. Application Data

[63] Continuation of Ser. No. 5,833, Jan. 21, 1987, abandoned.

[30] Foreign Application Priority Data

Jan. 21, 1986 [DE] Fed. Rep. of Germany ..... 3601670
Nov. 18, 1986 [DE] Fed. Rep. of Germany ..... 3639403

[51] Int. Cl.[5] ..... C21D 9/50

[52] U.S. Cl. ..... 148/127; 148/154; 148/150; 148/20.3; 148/145

[58] Field of Search ..... 148/127, 154, 150, 20.3, 148/145, 13 B; 278/231

[56] References Cited

U.S. PATENT DOCUMENTS

| | | | |
|---|---|---|---|
| 2,673,276 | 3/1954 | Allardt | 219/6 |
| 3,731,051 | 5/1973 | Ellersick | 219/162 |
| 4,142,713 | 3/1979 | Nakasugi et al. | 266/87 |
| 4,168,190 | 9/1979 | Eguchi et al. | 148/136 |
| 4,188,419 | 2/1980 | Delert et al. | 427/287 |

FOREIGN PATENT DOCUMENTS

| | | | |
|---|---|---|---|
| 1409114 | 7/1965 | France . | |
| 84925 | 5/1983 | Japan | 148/127 |
| 153841 | 9/1984 | Japan | 148/127 |
| 106921 | 6/1985 | Japan | 148/127 |
| 834156 | 6/1981 | U.S.S.R. | 148/127 |

OTHER PUBLICATIONS

Metals Handbook Heat Treating, vol. 4, 9 ed., pp. 623–646.

Metals Handbook, pp. 3–5, ©1981, vol. 4, Heat Treating.

VGB Kraftwerkstechnik 61, Pamphlet 9, p. 730, Sep. 1981.

Patent Abstracts of Japan, application No. 55 54 524.

Patent Abstracts of Japan, application No. 51 56 080.

*Primary Examiner*—Deborah Yee

*Attorney, Agent, or Firm*—Herbert L. Lerner; Laurence A. Greenberg

[57] ABSTRACT

A method for welding and heat treating straight bead welded pipes made of austenitic, ferritic or austenitic-ferritic rust-resistant steel includes welding a straight bead on a pipe forming a welding seam region, a heat affected zone and a remaining region, and annealing the pipe after welding the straight bead by only partially solution-annealing in the welding seam region and the heat affected zone, while heat treating the remaining region at a reduced temperature. An apparatus is also provided for carrying out the method.

16 Claims, 2 Drawing Sheets

METHOD FOR HEAT-TREATING STRAIGHT BEAD WELDED PIPES

Figure 1:
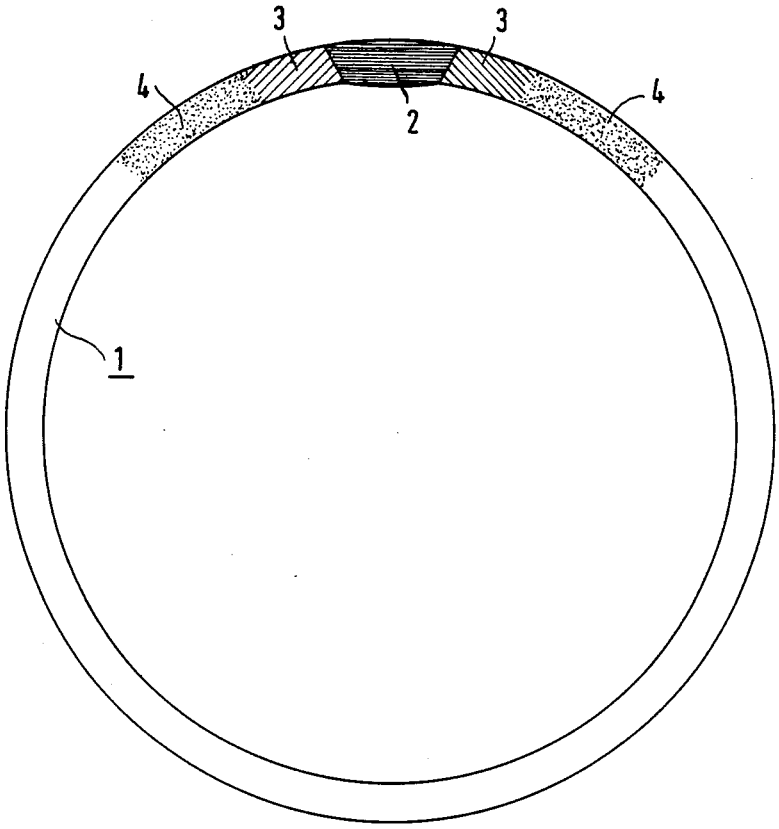

This application is a continuation, of application Ser. No. 005,833, filed Jan. 21, 1987, now abandoned.

The invention relates to a method for heat-treating straight bead welded pipes made of austenitic, ferritic or austenitic-ferritic rust-resistant steel, which comprises annealing the pipes after welding the straight bead and the invention also relates to an apparatus for carrying out the method.

After straight bead welding, rust-proof or rust-resistant steel pipes, which may be used with water vapor condensers, for example, are subjected to heat-treatment in order to decrease stresses and to reduce liquation which are the result of the welding process. This can be seen, for example from an article by K. Schleithoff and F. Schmitz, entitled "Kondensatorrohre aus nichtrostenden Stählen—Betriebserfahrungen und Werkstoffentwicklung" (Condenser Pipes of Rust-Resistant Steel—Operational Experiences and Material Development) in the publication "VGB Kraftswerkstechnik 61", Pamphlet 9, p. 730, Sept. 1981. As a rule the heat treatment is performed in continuous annealing ovens with the use of a protective gas at temperatures, depending on the material, of 950 degrees C. to 1,100 degrees C. and a holding or retardation time of a few minutes. Other annealing processes can also be used.

However, a basic problem occurs in that the optimal values of temperature and holding time cannot be achieved. If pipes are brought to the desired high temperatures, they are no longer structurally stable, so that they deform during longer holding times and "collapse" under the force of gravity. Therefore, in the welding region an optimal solution treatment and reduction of liquation of the elements chromium or molybdenum, for example, which determine the corrosion resistance, cannot be attained with the customary methods. Therefore the welding seam may show more inferior corrosion properties than the basic material in spite of the improvement through heat treating. For this reason the molybdenum content of the basic material is chosen higher than otherwise required in order to safeguard the corrosion properties desired in each case. From an economical standpoint, however, a reduction in the content of expensive molybdenum is desirable.

Another problem arises, especially in thin-walled pipes, because of the handling and transporting operations at high temperature. Deformations occur, especially dents, which make a subsequent quality test, such as by eddy current measurement, more difficult or impossible.

It is accordingly an object of the invention to provide a a method and apparatus for heat-treating straight bead or longitudinally welded pipes, which overcomes the hereinafore-mentioned disadvantages of the heretofore-known methods and devices of this general type and to treat the welding seams of straight bead welded pipes in such a manner that they approach the corrosion properties of the basic material while avoiding the disadvantages mentioned above. With the foregoing and other objects in view there is provided, in accordance with the invention, a method for welding and heat treating straight bead welded pipes made of austenitic, ferritic or austenitic-ferritic rust-resistant or rust-proof steel, which comprises welding a straight bead on a pipe forming a welding seam region, a heat affected zone and a remaining region, and annealing the pipe after welding the straight bead by only partially solution-annealing or heat treating in the welding seam region and the heat affected zone, while heat treating the remaining region at a reduced or lower temperature.

In accordance with another mode of the invention, there is provided a method which comprises selecting the material for the pipe as highly-alloyed molybdenum-containing steel, and performing the annealing step at a temperature higher than 1,100 degrees C. and preferably higher than 1,250 degrees C.

In accordance with a further mode of the invention, there is provided a method which comprises selecting the material for the pipe as ferritic steel, and performing the annealing step by annealing the welding seam region at a temperature higher than 950 degrees C.

In accordance with an added mode of the invention, there is provided a method which comprises maintaining an annealing temperature during the annealing step longer than 5 seconds and preferably substantially 25 seconds.

In accordance with an additional mode of the invention, there is provided a method which comprises partially heating or cooling the pipe for selective annealing.

In accordance with yet another mode of the invention, there is provided a method which comprises partially heating the pipe by means of infrared radiators or lasers.

In accordance with yet a further mode of the invention, there is provided a method which comprises partially heating the pipe with correspondingly conducted electrical currents, such as from saddle-shaped induction coils, and additionally cooling partial areas of the pipe, if required.

In accordance with yet an added mode of the invention, there is provided a method which comprises performing the heat treatment in an atmosphere from the group consisting of an atmosphere containing nitrogen and an atmosphere containing a compound giving off nitrogen, and performing the heat treatment at a partial pressure and a maximal annealing temperature raising the content of dissolved nitrogen in the welding seam region to more than 0.2% and preferably substantially between 0.3 and 0.4 without exceeding the solubility limit of the material.

With the objects of the invention in view there is also provided an apparatus for heat treating straight bead or longitudinally welded pipes of austenitic, ferritic or austenitic-ferritic rust-resistant steel, having a welding seam region, a heat affected zone and a remaining region, comprising means for only partially solution annealing the pipes in the welding seam region and the heat affected zone, while heat treating the remaining region at a reduced temperature.

In accordance with another feature of the invention, there is provided at least one infrared radiator, and means for focusing and concentrating radiation from the at least one infrared radiator on the welding seam region and the heat affected zone of the pipe, especially mirror surfaces with a parabolic cross section.

In accordance with a further feature of the invention, there is provided a protective envelope in which the pipe to be annealed is guided or supported, the protective envelope containing a protective gas in the interior thereof and being highly permeable to infrared rays, at least in partial regions thereof.

In accordance with an added feature of the invention, there are provided induction coils generating powerful currents in the welding seam region and the heat affected zone, due to the shape thereof and/or appropriately placed filters or screens.

In accordance with an additional feature of the invention, there is provided a cooling device for cooling the remaining region of the pipe, in other words except for the welding seam region and the heat affected zone.

In accordance with a concomitant feature of the invention, there are provided means for setting a defined partial pressure of nitrogen or a compound releasing nitrogen in a region surrounding the pipe, for heat treatment.

As further explained in connection with the drawings, the basic idea of the invention lies in performing only a partial solution annealing treatment of the welding seam and the heat affected zone. This annealing can be performed inside or outside of the welding line. For this purpose temperatures above 1,200 degrees C. or even 1,300 degrees C. in the welding seam region and the heat affected zone can be set, for example, in connection with highly-alloyed steel containing molybdenum, leading to optimized solution annealing and an improved evening-out of the chromium or molybdenum liquation. The remainder of the pipe wall temperatures of the other areas is set sufficiently low to permit trouble-free treatment in the welding, treatment, annealing and deformation lines, while at the same time achieving a reduction in the stresses caused by the manufacturing process. Since the largest part of the pipe is not brought to the maximum annealing temperature, the stability of the pipe is retained and undesirable deformations under the influence of gravity or the transporting devices cannot occur. Basically, the proposed annealing treatment offers the possibility of clearly increasing temperature as well as holding or retardation time in comparison with customary methods. It is also possible to produce thin-walled pipes.

The desired selective annealing can be achieved by partial heating and/or partial cooling. Depending on the desired holding time, a partial heating may be sufficient, although supplementation by means of cooling the pipe areas not to be annealed is always possible if the remainder of the pipe would be excessively heated by heat conduction or radiation during extensive holding time.

Different methods can be used for partial heating, for instance by the use of infrared radiators, lasers or correspondingly conducted electrical currents which are induced in the pipe.

An increased amount of nitrogen, which might be detrimental to the weldability of the material, can be attained after the welding process by annealing in an atmosphere having a suitable partial pressure of nitrogen or a nitrogen compound, as mentioned above. This considerably improves the corrosion properties of the pipe or the welding seam.

Other features which are considered as characteristic for the invention are set forth in the appended claims.

Although the invention is illustrated and described herein as embodied in a method and apparatus for heat-treating straight bead welded pipes, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
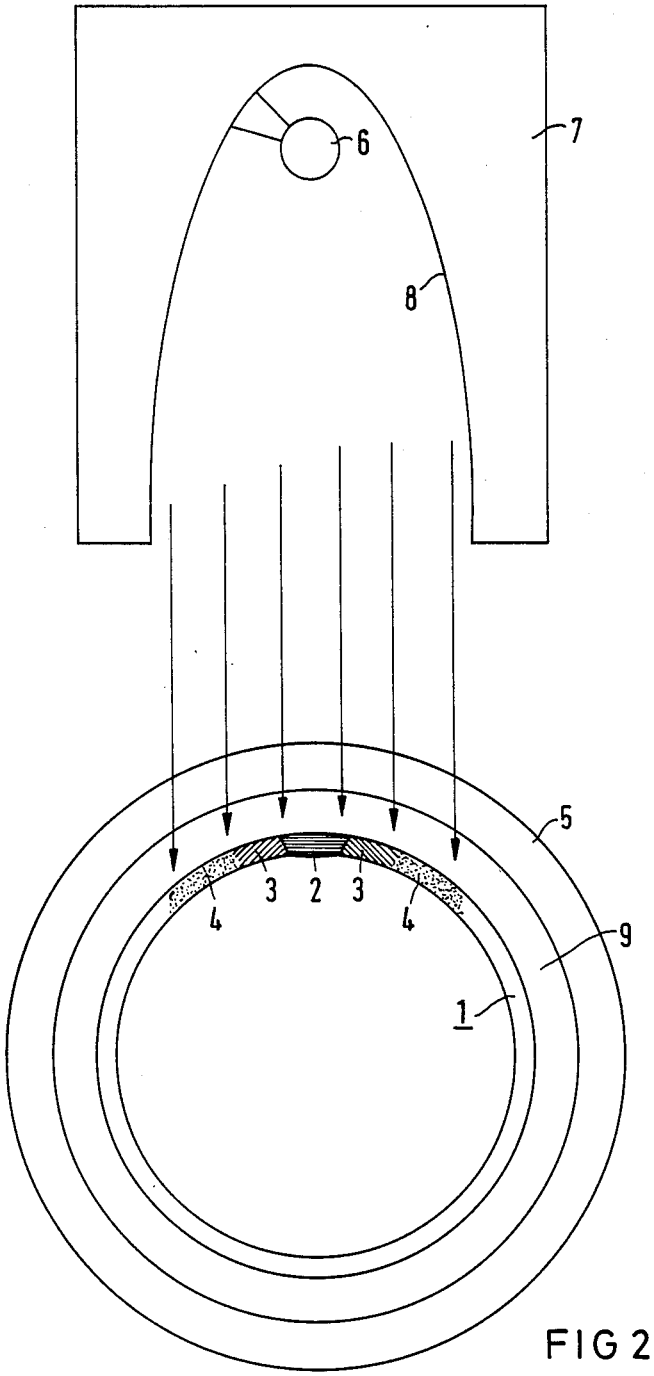

FIG. 1 is a diagrammatic cross-sectional view of a straight bead welded pipe illustrating various zones: and FIG. 2 is a cross-sectional view of an apparatus according to the invention for the partial annealing of such a pipe.

Referring now to the figures of the drawings in detail and first, particularly, to FIG. 1 thereof, there is seen a cross section of a straight bead welded pipe illustrating regions of the pipe important for the invention. The individual zones are not shown true to scale. During manufacture, a weld or welding seam 2 is generally located at the top of a pipe 1. The welding seam 2 is surrounded by a heat affected zone 3 where the welding process has left behind changes and inhomogeneities. The remainder of the pipe is formed of unchanged material, although it appears prudent, to be on the safe side, to include a region 4 outside of the heat affected zone 3 during heat treating, since the exact extent of the heat affected zone 3 is not always known.

An apparatus for the partial annealing of a straight bead welded pipe is shown in FIG. 2. Again, the welding seam 2 and the heat affected zone 3 surrounding it generally lie at the top of the pipe. Maximal heat treatment should extend to the welding seam 2, the heat affected zone 3 and the additional safety region 4, while the rest of the pipe is annealed free of stress at a low temperature. Due to the high annealing temperatures, the pipe 1 to be annealed is preferably to be contained within a protective gas in order to avoid subsequent corrosion. In the illustrated embodiment the pipe 1 to be annealed is contained inside a quartz glass pipe 5, in which an intermediate space 9 between the two is filled with a protective gas. One or more infrared radiators or lasers are disposed above the quartz glass pipe 5 and are provided with focusing reflectors 8 in a housing 7. The focusing reflectors can have a parabolic cross section, for example, with infrared radiators in the focal point or focal line thereof. However, other focusing elements, such as infrared pervious or permeable lens systems or the like, can be used. The infrared rays are focused in such a way that they radiate onto and heat the selected region 4 of the pipe 1 to be partially annealed.

Through the use of filters or screens or by supplemental cooling of the remainder of the walls of the pipe 1, the desired partial annealing can be performed at nearly random holding or retardation times, although annealing using a continuous process through a corresponding annealing line is preferable.

The invention permits the use of steel with a lower molybdenum content, for example, for straight bead welded corrosion-resistant pipes and also permits the manufacture of thin-walled pipes having a wall thickness of 0.3 to 0.5 mm, for example.

I claim:

1. Method for welding and heat treating straight bead welded pipes made of austenitic or austenitic-ferritic stainless steel, which comprises welding a straight bead on the pipe in axial direction forming a welding seam region, a circumferentially neighboring heat affected zone and a remaining circumferential region together encompassing the entire circumference of the pipe, and continuously heating the pipe along a corresponding annealing line after welding the straight bead for selectively solution-annealing in the welding seam region and the heat affected zone, while simultaneously heat treating the entire remaining circumferential region at a lower temperature.

2. Method for welding and heat treating straight bead welded pipes made of austenitic or austenitic-ferritic stainless steel, which comprises selecting the material for the pipe as highly-alloyed molybdenum-containing steel, welding a straight bead on the pipe in axial direction forming a welding seam region, a circumferentially neighboring heat-affected zone and a remaining circumferential region together encompassing the entire circumference of the pipe, and continuously heating the pipe along a corresponding annealing line after welding the straight bead for selectively solution-annealing at a temperature higher than 1,100 degrees C. in the welding seam region and the heat affected zone, while heat treating the entire remaining circumferential region at a lower temperature.

3. Method for welding and heat treating straight bead welded pipes made of austenitic or austenitic-ferritic stainless steel, which comprises selecting the material for the pipe as molybdenum-containing steel, welding a straight bead on the pipe in axial direction forming a welding seam region, a circumferentially neighboring heat affected zone and a remaining circumferential region together encompassing the entire circumference of the pipe, and continuously heating the pipe after welding the straight bead for selectively solution annealing at a temperature higher than 1,250 degrees C. in the welding seam region and the heat affected zone, while heat treating the entire remaining circumferential region at a lower temperature.

4. Method according to claim 1, which comprises maintaining a temperature for solution annealing during the annealing step longer than 5 seconds.

5. Method according to claim 1, which comprises maintaining a temperature for solution annealing during the annealing step for substantially 25 seconds.

6. Method according to claim 1, which comprises only partially heating the pipe for selective annealing.

7. Method according to claim 1, which comprises heating the entire pipe while partially cooling the pipe for selective annealing.

8. Method according to claim 1, which comprises partially heating the pipe by means of infrared radiators.

9. Method according to claim 1, which comprises partially heating the pipe by means of lasers.

10. Method according to claim 1, which comprises partially heating the pipe with correspondingly conducted inductive electrical currents.

11. Method according to claim 1, which comprises partially heating the pipe with correspondingly conducted inductive electrical currents from saddle-shaped induction coils.

12. Method according to claim 1, which comprises performing the heat treatment in an atmosphere from the group consisting of a protective atmosphere with added nitrogen and a protective atmosphere with an added compound giving off nitrogen, and performing the heat treatment at such a partial pressure of one of nitrogen and said compound and at such a maximal annealing temperature that the content of dissolved nitrogen in the welding seam region rises to more than 0.2% without exceeding the solubility limit for nitrogen of the material.

13. Method according to claim 12, which comprises performing the heat treatment at a partial pressure of one of nitrogen and said compound raising the content of the dissolved nitrogen in the welding seam region to substantially between 0.3 and 0.4%.

14. Method according to claim 10, which comprises additionally cooling partial areas of the pipe.

15. Method according to claim 11, which comprises additionally cooling partial areas of the pipe.

16. Method according to claim 1, which comprises selecting a pipe diameter and a wall thickness substantially equivalent to that of condenser tubes.

* * * * *